United States Patent [19]

Rolando

[11] 4,028,744

[45] June 14, 1977

[54] JACKET OF KNITTED JERSEY FABRIC

[75] Inventor: Pierluigi Rolando, Vicolungo, Italy

[73] Assignee: Maglificio Biellese Fratelli Fila S.p.A., Biella, Italy

[22] Filed: May 13, 1975

[21] Appl. No.: 577,046

[30] Foreign Application Priority Data

May 16, 1974 Italy ..... 21180/74[U]

[52] U.S. Cl. ..... 2/108; 2/122

[51] Int. Cl.[2] ..... A41D 1/02

[58] Field of Search ..... 2/90, 93, 106, 108, 2/115, 116, 118, 122, 143, 243 R, 243 B

[56] References Cited

UNITED STATES PATENTS

| | | | |
|---|---|---|---|
| 1,694,206 | 12/1928 | Clements | 2/106 X |
| 2,304,251 | 12/1942 | Freedman | 2/115 |
| 2,322,451 | 6/1943 | Jones | 2/93 |
| 2,462,361 | 2/1949 | Cassens | 2/108 |
| 2,554,361 | 5/1951 | Ettien et al. | 2/93 |
| 2,751,596 | 6/1956 | Bagaloff | 2/93 |
| 3,153,793 | 10/1964 | Lepore | 2/108 X |
| 3,744,052 | 7/1973 | Rector | 2/93 X |

FOREIGN PATENTS OR APPLICATIONS

| | | | |
|---|---|---|---|
| 925,418 | 3/1947 | France | 2/93 |
| 311,457 | 10/1933 | Italy | 2/106 |
| 1,295,638 | 11/1972 | United Kingdom | 2/115 |

*Primary Examiner*—Werner H. Schroeder
*Assistant Examiner*—Moshe I. Cohen
*Attorney, Agent, or Firm*—Michael J. Striker

[57] ABSTRACT

A knitted jersey fabric jacket has a body which consists of a rear panel, a pair of side panels, and a pair of front panels. The rear panel has inwardly arcuate edge portions which extend between shoulder and waist portions of the rear panel, and the side panels which are each of one piece are connected to the edge portions of the rear panel. The front panels are each connected to the side panels and each consists of a first section of an irregular hexagonal configuration and a second section of a substantially rectangular configuration. Sleeves are connected to the body, and cuffs, collar and border are connected to the sleeves and the body, respectively. Inverted V-shaped reinforcing elements are connected to the side panels, extending from the rear to the front of the jacket.

5 Claims, 2 Drawing Figures

JACKET OF KNITTED JERSEY FABRIC

This invention relates to an improved jacket of knitted jersey fabric, which is provided with border, collar and cuffs sewn on its body.

As well known, among the clothing items are knitted jackets of particular configurations, better known as blouses. The manufacture of such items according to traditional principles involves manufacturing difficulties, especially as regards the convenient connection of the borders, collar and cuffs to such clothing items.

The above-mention inconvenience is eliminated in the specific configuration of the jacket according to this invention.

The jacket is provided with border, collar and cuffs, sewn to its body, which is preferably made of jersey knitted fabric.

The body of the jacket is advangeously obtained by sewing together four shaped panels.

These and further characteristic features of a functional and constructional nature of the jacket of knitted jersey fabric according to the present invention will become more apparent from the following detailed description taken in conjunction with the various figures on the accompanying drawings, in which.

Figure 1:
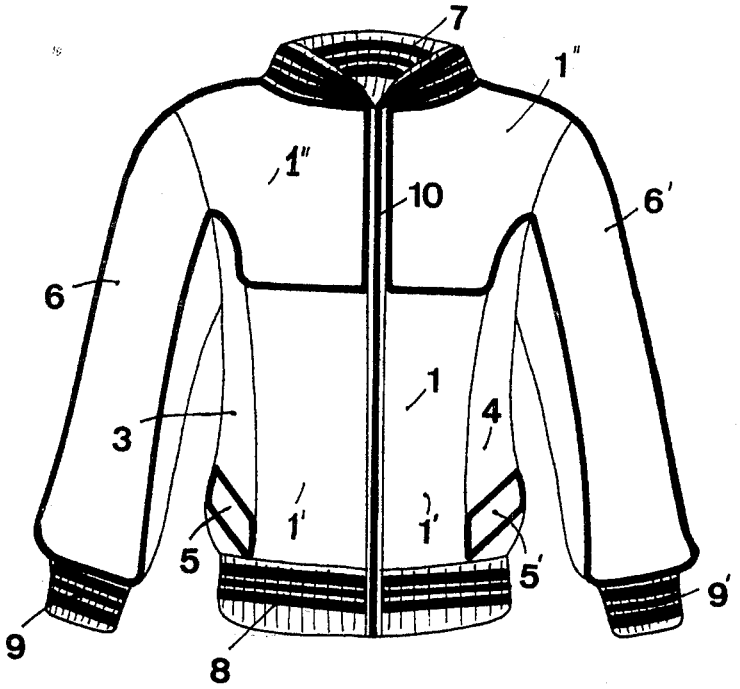
FIG. 1 shows the jacket according to this invention in a front view.
Figure 2:
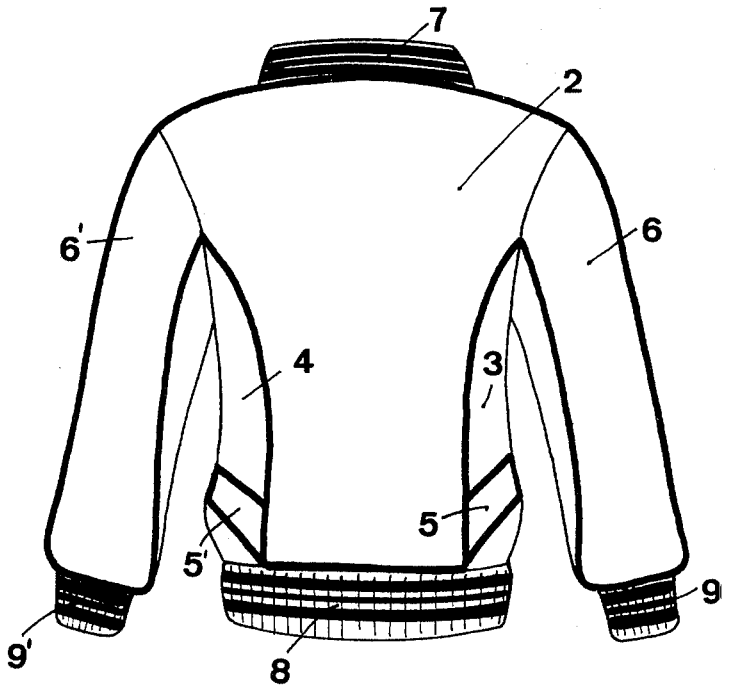
FIG. 2 represents the same jacket as above in a rear view.

Referring now particularly to the reference numerals appearing in the various figures on the accompanying drawing, the jacket according to this invention consists of four shaped panels 1, 2, 3 and 4, sewn together so as to form a body of the clothing item.

In particular, the front panel 1 is made up of two pairs of horizontal sections 1' and 1'' which are rectangular and shaped like and irregular hexagon, respectively, whereas the rear panel 2 has a complex configuration being, approximately T-shaped but with curved vertical edges having an inwardly arcuate shape.

Two side panels 3 and 4 are provided with two inserts 5 and 5' having an inverted V-shaped configuration with rather wide and divergent rods.

To the thus assembled body, there are connected two sleeves 6 and 6', each consisting of two cloths of appropriate shapes.

To the body with sleeves, there are affixed a collar 7, a border 8 and cuffs 9 and 9', preferably of ribbed knitted fabric. The panel 1, constituting the front portion of the body is further provided with an intermediate slide fastener 10, adapted to allow a complete opening of the clothing item.

From the foregoing description and from perusal of the various figures one may see easily the functional character and pratical use of the jacket of knitted jersey fabric according to this invention.

I claim:

1. As a novel article of manufacture, a knitted jersey fabric jacket comprising a rear panel having a shoulder portion, a waist portion, and a pair of inwardly arcuate edge portions extending between said shoulder portion and said waist portion; a pair of side panels each being of one piece and having a waist zone and respectively connected to said edge portions of said rear panel along first seams; a pair of front panels having shoulder regions respectively connected to said shoulder portion of said rear panel along second seams, and lateral edge regions connected to said side panels along third seams so that said rear, side and front panels together constitute a body of said jacket in which said side panels extend between the front and the rear of said body, each of said front panels including a first section having said shoulder region and being of an irregular hexagonal shpae, and a substantially rectangular second section having a waist region and connected to said first section along a fourth seam; and a pair of reinforcing elements of inverted V-shaped configurations respectively connected to said side panels at locations which are spaced from said waist zones and extending toward said rear and front panels, respectively.

2. An article as defined in claim 1, wherein said shoulder portion and regions have respective marginal zones; and further comprising sleeves connected to said marginal zones along fifth seams.

3. An article as defined in claim 2, wherein said sleeves have free ends; and further comprising cuffs connected to said free ends of said sleeves.

4. An article as defined in claim 1, wherein said shoulder portion and regions have respective collar zones; and further comprising a collar connected to said collar zones.

5. An article as defined in claim 1, wherein said side panels have waist zones; and further comprising a border connected to said waist portion, zones and regions.

* * * * *